United States Patent [19]

Bisbing

[11] 4,330,145

[45] May 18, 1982

[54] DOUBLE-LATCH MECHANISM

[75] Inventor: Robert H. Bisbing, Springfield, Pa.

[73] Assignee: Southco, Inc., Concordville, Pa.

[21] Appl. No.: 175,485

[22] Filed: Aug. 5, 1980

[51] Int. Cl.[3] ..... E05C 1/16

[52] U.S. Cl. ..... 292/37

[58] Field of Search ..... 292/37, 40, 169.13, 292/156, 159, 157, 161, DIG. 40, DIG. 41, DIG. 72

[56] References Cited

U.S. PATENT DOCUMENTS

| | | | |
|---|---|---|---|
| 281,109 | 7/1883 | Milton | 292/37 |
| 1,428,367 | 9/1922 | Forlander | 292/DIG. 40 |
| 1,669,227 | 5/1928 | Blouser | 292/159 X |
| 1,833,994 | 12/1931 | Hines | 292/DIG. 41 |
| 3,650,554 | 3/1972 | Thorp | 292/DIG. 72 |

*Primary Examiner*—Richard E. Moore

*Attorney, Agent, or Firm*—Paul & Paul

[57] ABSTRACT

A door-mounted double-latch mechanism consists of two forwardly-sprung latching pawls which are adapted to engage a keeper mounted on the door jamb. One of the latching pawls, the secondary pawl, has a wider keeper-receiving recess at its forward end than does the primary pawl, so that the secondary pawl will snap behind the keeper before the primary pawl does. As a result, even if the door is not fully closed, the secondary latching pawl will nevertheless be engaged. Mounted on the inside of the door is a cam with a bent-up tab which is adapted to engage both pawls. When the cam is rotated in one direction the primary pawl is caused to retract. When the cam is rotated in the opposite direction the secondary pawl is caused to retract. Sandwiched between the two pawls is a spring-biased lever the primary purpose of which is to urge the door outwardly, ie., towards the open position.

6 Claims, 10 Drawing Figures

DOUBLE-LATCH MECHANISM

BACKGROUND OF THE INVENTION

This invention relates to latches for doors and the like. The invention relates particularly to a type of latch mechanism which may be referred to as a double latch. Such a latch has two positions, (1) a fully latched position and (2) a secondary latched position.

Double-latch mechanisms have been used in the prior art on motor vehicle hoods and doors. Federal Motor Vehicle Safety Standard No. 206 specifies the requirements for motor vehicle door. The latch of the present application is not intended for the motor vehicle market.

Double-latch mechanisms of the type covered by the present invention are useful in stationary machinery, in heavy off-the-road mobile equipment, and elsewhere.

SUMMARY OF THE INVENTION

A principal object of the present invention is to provide a latch mechanism having two latched positions so that in the event the primary latched position is not in full engagement, even though it may appear to be, the secondary latched position is in full engagement.

Another object of the invention is to provide a latch mechanism requiring two separate operations to open it, thereby providing a higher degree of safety against accidental opening of the latch.

A further object of the invention is to provide a latch mechanism having a secondary latch position which will be effective to prevent opening of the door or other element in the event the primary latch position should fail, either of itself or as a result of adverse outside forces such as those resulting from vibration or impact.

DETAILED DESCRIPTION OF THE PREFERRED EMBODIMENTS

Figure 1:
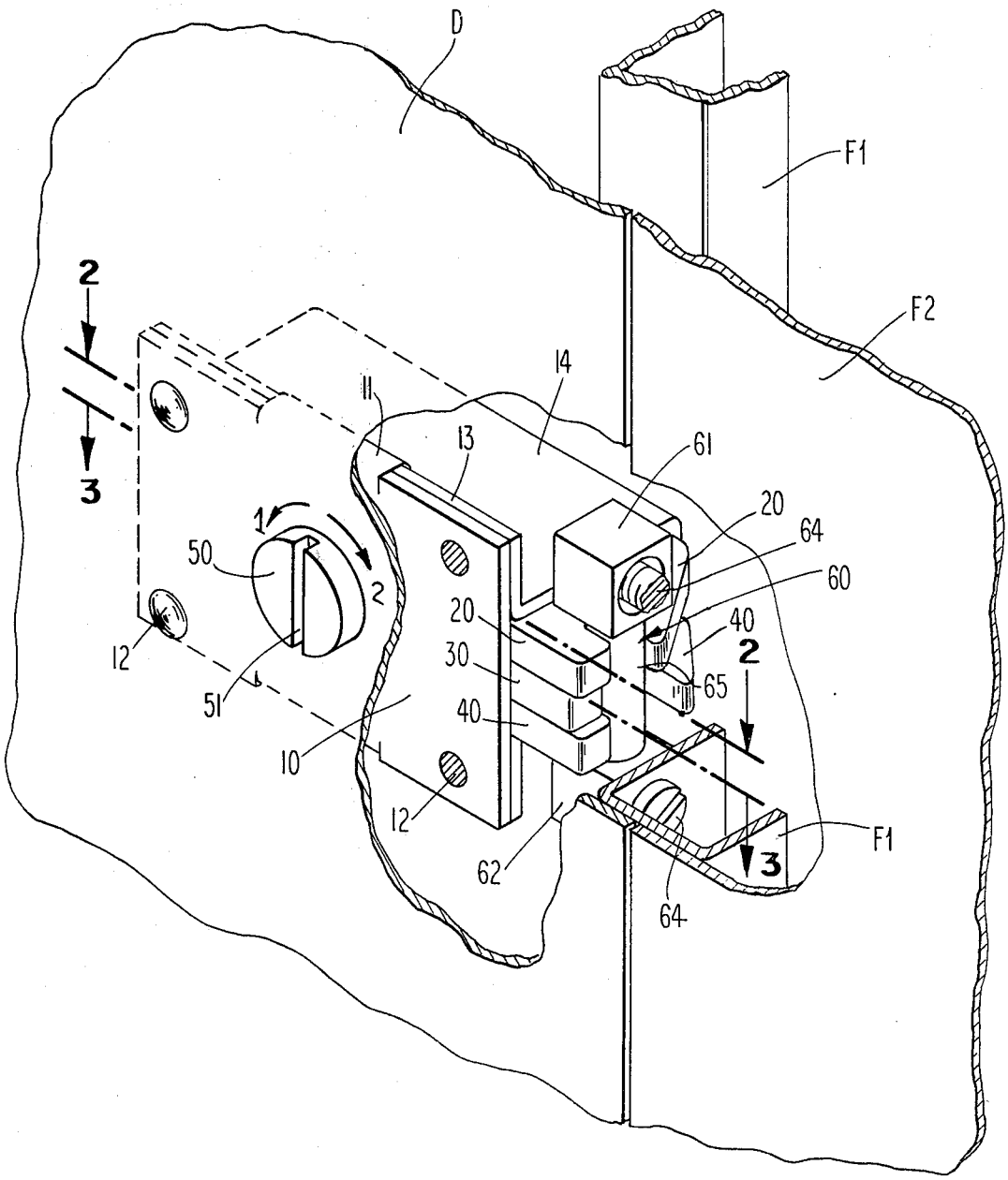
FIG. 1 is a perspective view, partly broken away, showing the double-latch mechanism mounted on a door shown in closed position.

Referring now to FIG. 1, there is shown a door D which abuts against a door jamb or frame member F1. Mounted on door D, as by rivets 12, is a flat plate 10 having upper and lower ears 11 which are bent over to secure the upper and lower flange portions 13 of a channel shaped housing 14. Mounted within housing 14 is a double-latch mechanism according to the present invention.

The double-latch mechanism of the present invention includes a primary pawl 20, a secondary pawl 40, and sandwiched between the two pawls 20 and 40, is a lever 30. As seen in FIGS. 1,2,6–8, the forward end of the primary pawl 20 is provided with a recess 21 having a cross-sectional width corresponding to that of the cylindrical keeper post 65. And, as seen in FIGS. 1,2,3,6,7, the forward end of the secondary pawl 40 is provided with a recess 41 having a width approximately twice that of the keeper post 65.

At its rearward end, primary pawl 20 is provided with a slot 23 which receives a compression spring 24. The rearward end of spring 24 bears against the rear wall 15 of the housing 14.

Secondary pawl 40, at its rearward end, is similarly provided with a slot 43 adapted to receive a compression spring 44, the rearward end of which bears against the rear wall 15 of the housing 14.

At its forward end, lever 30 is provided with a forwardly projecting finger which is adapted to engage the outer surface of keeper post 65 of keeper 60.

At an intermediate location, the sidewall of lever 30 is provided with a slot 33 which is adapted to receive a compression spring 34. The outward end of spring 34 bears against the base plate 10.

The primary and secondary pawls 20 and 40 have widths corresponding to the width of the housing 14, where "width" is in the direction perpendicular to the door. As a result, there is no relative movement, in the width direction, between the pawls and the housing. And, since base plate 10 of the housing 14 is secured to the door D, there is no relative movement between the pawls and the door. Lever 30, on the other hand, has a width which is less than that of the housing and as a result lever 30 is movable within the housing, being pivotal at the rearward wall 15 by means of a foot 35 which projects through a slot in the wall. Since, lever 30 is pivotally movable within housing 14, lever 30 is also pivotally movable relative to door D.

Keeper 60 comprises upper and lower square ends 61, 62 and an intermediate cylindrical keeper post 65. The square ends of the keeper are secured, as by screws 64 to the door jamb or channel frame F1.

Projecting through door D and base plate 10 is a cam shaft 52 on which a cam body 55 is supported for rotational movement. Cam body 55 has a tab 56.

At their outward edges, i.e. at the edge closest to the door D, pawls 20 and 40, and lever 30, are each provided with a recess for receiving the cam body 55 and cam tab 56. The recesses of the pawls 20 and 40 are stepped, forming shoulders 25 and 45, respectively, so that when the cam shaft 52 is rotated in the one direction the cam tab 56 pushes against the shoulder 25 of the primary pawl 20 causing pawl 20 to move rearwardly from the position shown in FIG. 2 to the retracted position shown in FIG. 6, and when the cam shaft 52 is rotated in the opposite direction the cam tab 56 pushes against the shoulder 45 of secondary pawl 40 causing pawl 40 to move rearwardly from the position shown in FIG. 6 to the retracted position shown in FIG. 8.

To close door D, it may merely be slammed shut. The inclined nose portions of pawls 20 and 40 are thereupon cammed rearwardly by the keeper post 65 against the actions of the respective compression springs 24 and 44, and the door D and the double-latch mechanism take the positions illustrated in FIG. 1.

Figure 7:
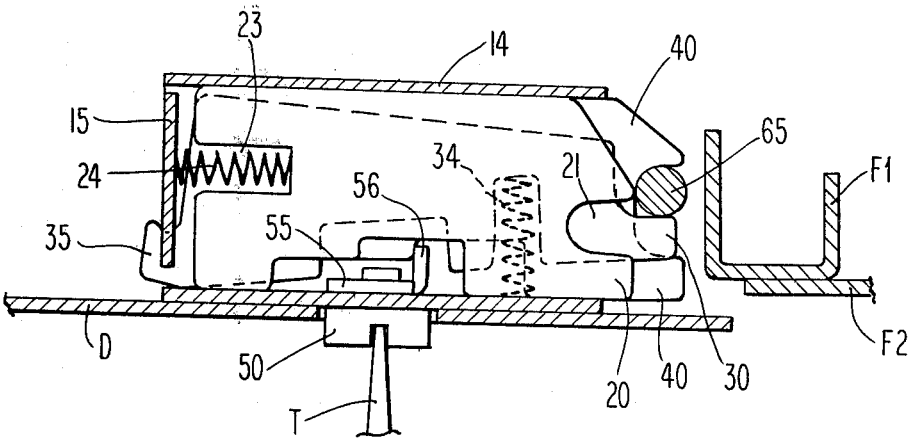
FIG. 7 is a view showing the door open but retained by the secondary pawl, the primary pawl being shown released from its fully retracted position, the nose of the primary pawl pressing against the keeper on the door side of the keeper center line.
Figure 8:
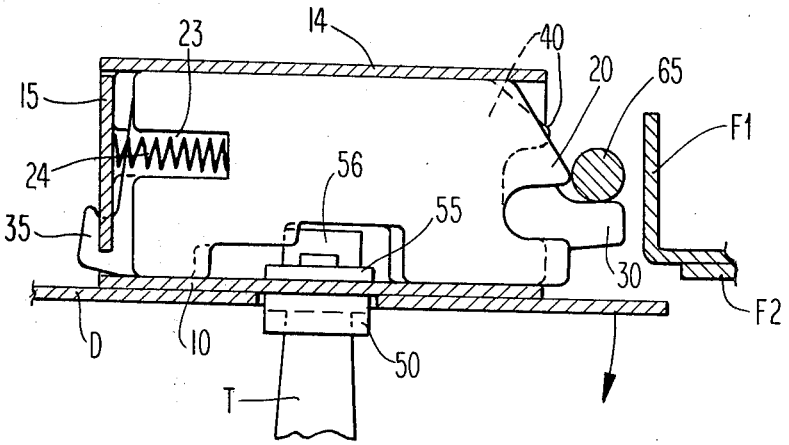
FIG. 8 is a view showing the secondary pawl in retracted position and the lever urging the door toward fully open position.

To open the door, the latch mechanism is released by rotating cam shaft 52 first in the counter-clockwise direction and then in the opposite or clockwise direction. Such rotation of the cam shaft 52 may be accomplished by various means. In FIGS. 1 through 8, the cam shaft 52 is shown to be equipped with a slotted head 50 and rotatable by the insertion of a screw driver or other tool T into the slot 51 as illustrated in FIGS. 6–8.

Figure 2:
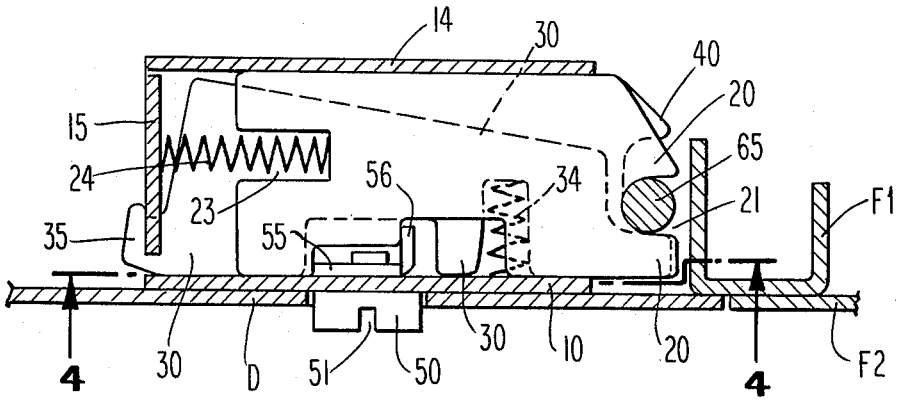
FIG. 2 is a view looking down along the line 2—2 in FIG. 1 showing the latch in fully closed position.
Figure 3:
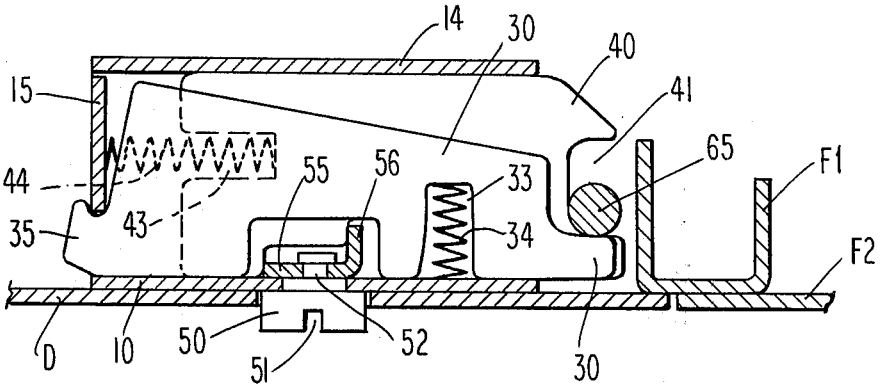
FIG. 3 is a view similar to that of FIG. 2 but looking down along the line 3—3 of FIG. 1, showing only the lever and secondary pawl.
Figure 4:
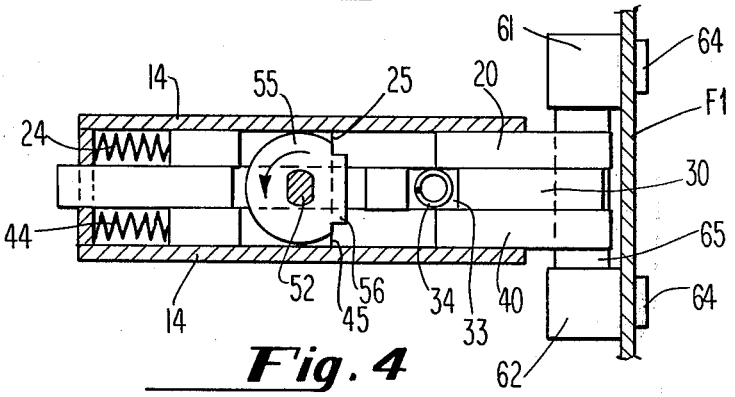
FIG. 4 is an elevational view looking along the line 4—4 of FIG. 2 showing the latch in fully closed position.
Figure 5:
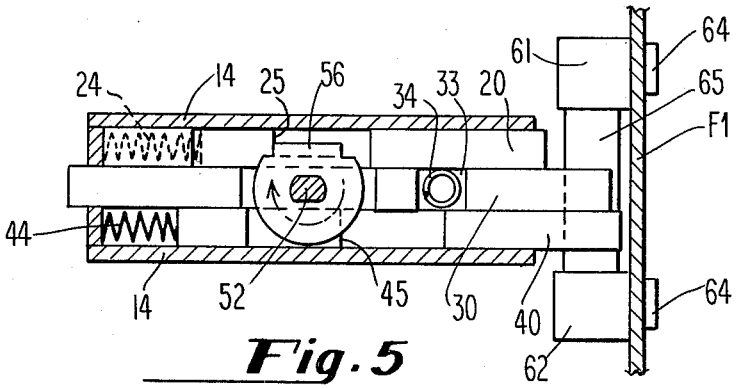
FIG. 5 is an elevational view looking along the line 5—5 of FIG. 6 showing the primary pawl in retracted position.
Figure 6:
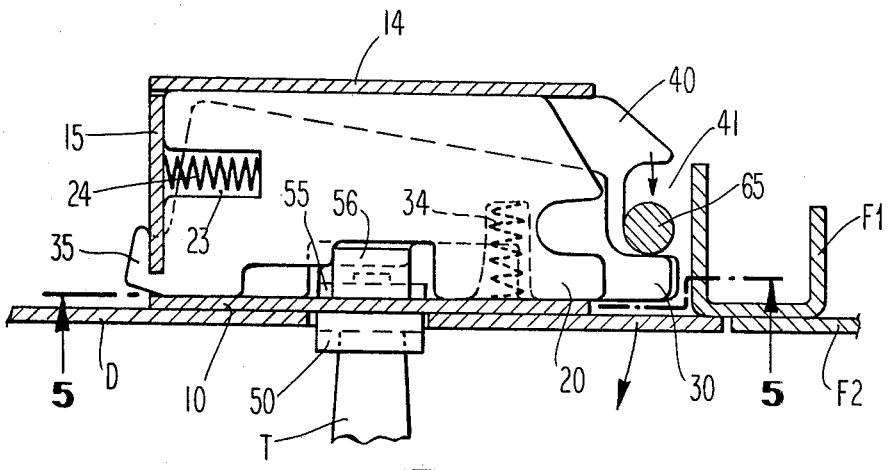
FIG. 6 is a view similar to that of FIG. 2 but showing the primary pawl in retracted position.

When the cam shaft 52 is rotated 90° in the counter-clockwise direction, the cam tab 56 engages shoulder 25 and moves primary pawl 20 rearwardly from the forward position shown in FIG. 2 to the retracted position shown in FIGS. 5 and 6. This allows spring 34 to expand and door D moves outwardly until keeper post 65 engages the inward wall of recess 41 of secondary pawl 40. This is illustrated in FIG. 7.

In FIG. 7, the primary pawl 20 is shown having returned from its fully retracted position shown in FIG. 6 to a position in which the nose of pawl 20, just beyond recess 21, abuts against the keeper post 65. This abutting position of pawl 20 is not taken until after the cam shaft 52 is rotated clockwise in a direction to retract the secondary pawl 40. This clockwise movement of cam shaft 52 releases the primary pawl 20 and, under the action of spring 24, the primary pawl 20 moves forwardly to the position shown in FIG. 7 wherein the nose of pawl 20 abuts against the keeper post 65 on the door side of the center line of the keeper post. During the last 90° of the total 180° clockwise movement of cam shaft 52, the cam tab 56 is engaged with shoulder 45 of secondary pawl 40 and is moving the secondary pawl rearwardly to the fully retracted position shown in FIG. 8. As soon as the nose of pawl 40 clears the keeper post 65, the door D moves outwardly under the action of spring 34 which is constantly applying force between the lever 30 and the door D urging the door D outwardly.

Thus, as soon as the inclined nose portion of secondary pawl 40 clears the secondary post 65, the door D moves outwardly toward fully open position. This is illustrated in FIG. 8 which shows door D in a position in which it is able to move fully outwardly.

Figure 9:
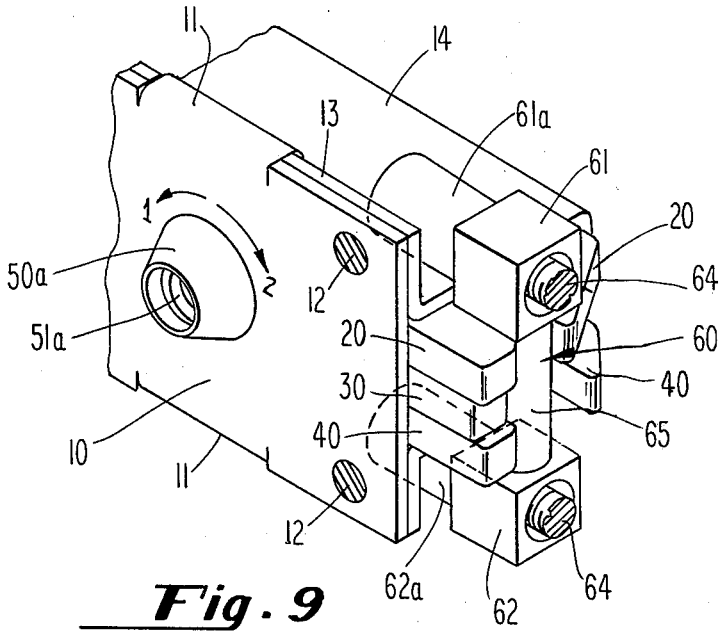
FIGS. 9 and 10 are perspective views showing the forward portion of the double latch mechanism modified to include additional stop members to prevent movement in the vertical and lateral directions relative to the keeper. The figures also show alternate forms of drive for the cam shaft.

Reference is now made to FIG. 9 which shows a modification intended to prevent vertical movement between the double latch mechanism and the keeper 60. In FIG. 9, the latch mechanism is similar to that illustrated in FIG. 1 except that pins 61*a* and 62*a* have been added. These pins extend rearwardly from the square heads 61 and 62 of the keeper 60. The clearance between the pins 61*a*, 62*a* and the surface of housing 14 is small, being sufficient to allow pivotal movement of the door and its latch mechanism relative to the keeper which is mounted on the door jam, but insufficient to permit any substantial amount of vertical movement of the latch mechanism relative to the keeper.

FIG. 9 also illustrates a modification with respect to the drive means for rotating the cam shaft 52. In FIG. 1, the cam shaft 52 is merely fitted with a head 50 having a slot 51 adapted to receive a screwdriver or other suitable tool. In FIG. 9, the cam shaft 52 is provided with a tamper proof socket head of the type shown, described and claimed in U.S. patent application Ser. No. 032,212, filed Apr. 23, 1979 by William R. Frame and Robert H. Bisbing now U.S. Pat. No. 4,258,596 issued Mar. 31, 1981 and assigned to the assignee of the present application. The tamper proof head 50*a* shown in FIG. 9 is similar to the head shown in FIG. 5 of the aforesaid patent application.

Figure 10:
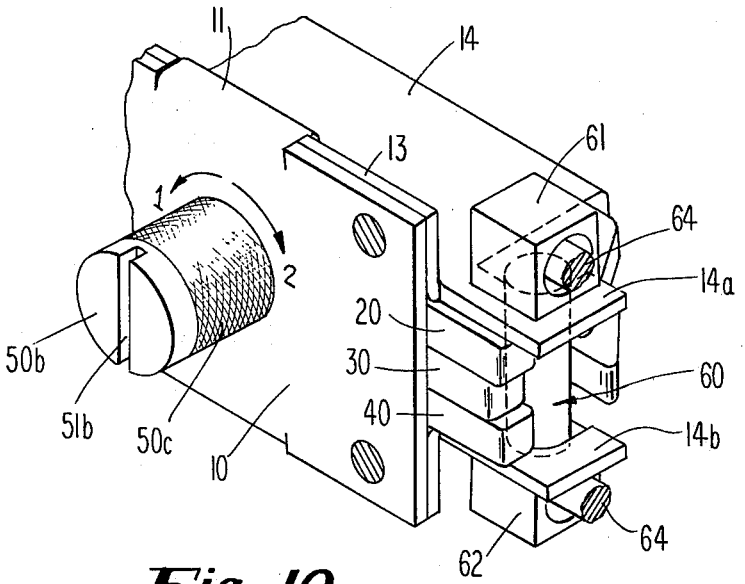

FIG. 10 illustrates a further modification intended to prevent lateral movement between the latch mechanism and the keeper. In FIG. 10, the housing 14 is extended toward the keeper 60 and provided with hook portions 14*a* and 14*b* forming recesses which receive the keeper post 65. The clearance between the keeper post 60 and housing 14 (including the hook portions 14*a* and 14*b*) is small being sufficient to allow pivotal movement of the door latch mechanism relative to the stationary keeper post but insufficient to allow any significant movement in the lateral direction between the door latch mechanism and the keeper.

FIG. 10 also illustrates yet another driving head for the cam shaft 52. In FIG. 10, the slotted head 50*b* includes a knurled surface 50*c* to permit rotation of the cam shaft 52 by hand.

While the present application shows three different drive means for cam shaft 52, other suitable means may be employed so far as the present invention is concerned.

What is claimed is:

1. In combination; a latch mechanism adapted to be mounted on a door or like member, and a keeper adapted to be mounted on the door jamb, said latch mechanism comprising:

a. a primary pawl having at its forward end a recess having a width corresponding to the width of said keeper;

b. a secondary pawl having at its forward end a recess having a width substantially greater than that of said keeper;

c. a lever sandwiched between said primary and secondary pawls, said lever having at its forward end a forwardly projecting finger adapted to engage the outer surface of said keeper;

d. compression spring means between said lever and said door for urging said door outwardly relative to said lever;

e. spring means biasing said primary pawl forwardly toward said keeper, whereby said keeper is received in said recess of said primary pawl, thereby to prevent outward movement of said door;

f. spring means biasing said secondary pawl forwardly toward said keeper, whereby said keeper is received in said wide recess of said secondary pawl, whereby said secondary pawl is free to move relative to said keeper unless prevented by said primary pawl;

g. cam means mounted on said door in such position as to be adapted for engagement with both said primary and secondary pawls;

h. means for rotating said cam means in one direction for retracting said primary pawl, whereby said keeper clears said recess of said primary pawl; thereby to allow said lever to move said door outwardly to a first limit position;

i. means for rotating said cam means in the opposite direction for retracting said secondary pawl, whereby said keeper clears said wide recess of said secondary pawl, thereby to allow full opening of said door.

2. Apparatus according to claim 1 wherein means are provided for inhibiting relative movement between said latch mechanism and said keeper in a plane parallel to that of said door.

3. Apparatus according to claim 3 wherein said means for inhibiting said movement comprises a pair of projections from said keeper in a plane parallel to that of said door, said projections extending toward said latch mechanism.

4. Apparatus according to claim 1 wherein means are provided for inhibiting relative movement in a straight line between said latch mechanism and said keeper in a plane normal to that of said door.

5. Apparatus according to claim 4 wherein said inhibiting means comprises a pair of hook members which project from the housing of said latch mechanism.

6. In combination; a latch mechanism adapted to be mounted on a door or like member, and a keeper adapted to be mounted on the door jamb, said latch mechanism comprising:

a. a primary pawl having at its forward end an inclined nose portion having an edge adapted to engage with said keeper;

b. a secondary pawl having at its forward end an inclined nose portion having an edge adapted to engage with said keeper; said edge of said secondary pawl being more remote from said door than said edge of said primary pawl;

c. a lever disposed in a plane parallel to those of said primary and secondary pawls, said lever having at its forward end a forwardly projecting finger adapted to engage the surface of said keeper nearer to said door;

d. compression spring means between said lever and said door for urging said door outwardly relative to said lever;

e. compression spring means biasing said primary pawl forwardly toward said keeper, whereby said keeper is engaged by said edge of said primary pawl, thereby to prevent outward movement of said door;

f. compression spring means biasing said secondary pawl forwardly toward said keeper to such position that said edge of said secondary pawl is remote from said keeper, whereby said secondary pawl is free to move toward a door-opening position relative to said keeper unless prevented by said primary pawl;

g. cam means mounted on said door in a position adapted for operative engagement with both said primary and secondary pawls;

h. means for rotating said cam means in one direction for engaging and retracting said primary pawl, whereby said keeper clears said edge of said primary pawl, thereby to allow said lever to move said door outwardly to a first limit position;

i. means for rotating said cam means in the opposite direction for engaging and retracting said secondary pawl, whereby said keeper clears said edge of said secondary pawl, thereby to allow full opening of said door.

* * * * *